US006078232A

United States Patent [19]

Saito

[11] Patent Number: 6,078,232

[45] Date of Patent: Jun. 20, 2000

[54] ELECTROMAGNETIC RELAY

[75] Inventor: Masao Saito, Tokyo, Japan

[73] Assignee: NEC Corporation, Tokyo, Japan

[21] Appl. No.: 09/418,464

[22] Filed: Oct. 15, 1999

[30] Foreign Application Priority Data

Oct. 16, 1998 [JP] Japan ..... 10-294907

[51] Int. Cl.[7] ..... H01H 51/22

[52] U.S. Cl. ..... 335/78; 335/80

[58] Field of Search ..... 335/78–86, 124, 335/128, 4

[56] References Cited

U.S. PATENT DOCUMENTS

| | | | |
|---|---|---|---|
| 4,881,053 | 11/1989 | Tanaka et al. | 335/80 |
| 5,734,308 | 3/1998 | Dittmann et al. | 335/78 |
| 5,880,655 | 3/1999 | Dittmann et al. | 335/124 |

FOREIGN PATENT DOCUMENTS

| | | |
|---|---|---|
| 5-174689 | 7/1993 | Japan . |
| 6-12958 | 1/1994 | Japan . |
| 7-211212 | 8/1995 | Japan . |

*Primary Examiner*—Lincoln Donovan
*Assistant Examiner*—Tuyen T. Nguyen

[57] ABSTRACT

The electromagnetic relay is provide with a spring fixing part which fixes a signal contact spring, an earth contact spring and a spring connection portion to a board, and an armature made of a magnetic member and arranged to be rockable with a position matching with the spring fixing part. The armature is provided with a first end portion which presses the signal contact spring against signal fixed contacts and a second end portion which presses the earth contact spring against an earth fixed contact. The armature and each of the movable portions are arranged such that torques acting on the armature cancel one another by a repulsion of each of the contact springs when the signal contact spring and the earth contact spring are pressed against the board.

10 Claims, 12 Drawing Sheets

ELECTROMAGNETIC RELAY

BACKGROUND OF THE INVENTION

1. Field of the Invention

The present invention relates to an electromagnetic relay in which the connection of a signal transmission path is switched by controlling an electromagnet which rocks an armature.

2. Description of the Related Art

FIG. 1 is a cross-sectional view showing a conventional electromagnetic relay.

In the conventional electromagnetic relay 101, an electromagnet block 130 and a contact spring block 120 are contained within a case 140. An opening portion is provided at the lower portion of the case 140 and a relay board 110 is fitted into the opening portion.

The electromagnetic block 130 is provided with a spool 134 formed integrally with a core 131 and an insulating member. A coil 133 is wound in the groove of the spool 134. An electromagnet 138 thus constituted is provided in the electromagnetic block 130. The core 131 is generally U-shaped and the both end portions of the core 131 serve as magnetic poles 131*a* and 131*b*, respectively, of the electromagnet 138. A permanent magnet 132 is arranged almost at the central portion of the core 131.

The electromagnetic relay 101 is also provided with an armature 136 made of magnetic material. A protrusion-like support portion 136*c* polarized by the permanent magnet 132 is formed at the central portion of the armature 136. The armature 136 is rockable like a seesaw with respect to the electromagnet 138 about the support portion 136*c*. Studs 137*a* and 137*b* protruding in the opposite direction to the support portion 136*c* are provided on the tip ends of arms 136*a* and 136*b* of the armature 136, respectively. A hinge spring (not shown) applying an elastic force in the direction in which the end portion of the arm 136*a* is abutted against the magnetic pole 131*a*, is provided at the central portion of the armature 136.

The magnetic force of the electromagnet 138 is set higher than a combination of the recovery force of the hinge spring, the magnetic force of the permanent magnet 132 and the like. Thus, while the electromagnet 138 is de-excited, the end portion of the arm 136*a* of the armature 136 is abutted against the magnetic pole 131*a* by the recovery force of the hinge spring and the magnetic force of the permanent magnet 132. While the electromagnet 138 is excited, the end portion of the arm 136*b* is abutted against the magnetic pole 131*b* by the magnetic force of the electromagnet 138.

FIG. 2 is a plan view showing the contact spring block 120 of the conventional electromagnetic relay 101.

In the contact spring block 120 of the electromagnetic relay 101, a make contact plate spring 121 and an earth contact plate spring 123 serving as signal contact springs are connected to each other by a spring connection portion 150. A break contact plate spring 122 and an earth contact plate spring 123' serving as signal contact springs are connected to each other by a spring connection portion 150'. The spring connection portions 150 and 150' are the same in width as the respective contact plate springs. These plate springs are made of conductive members. A first movable spring part is constituted by the make contact plate spring 121, the earth contact plate spring 123 and the spring connection portion 150. A second movable spring part is constituted by the break contact plate spring 122, the earth contact plate spring 123' and the spring connection portion 150'. The make contact plate spring 121 and the break contact plate spring 122 are arranged to put a spring fixing part 124 therebetween. The spring fixing part 124 is fixed to the front surface of the relay board 110.

The direction in which the first and second movable spring parts extend is the same as the lengthwise direction of the armature 136.

The free end of the make contact plate spring 121 and that of the break contact plate spring 122 are T-shaped. Make contacts 121*a* and 121*a'* are provided on the free end portions of the make contact plate spring 121, respectively. Brake contacts 122*a* and 122*a'* are provided on the free end portions of the break contact plate spring 122, respectively. Earth contacts 123*a* and 123*a'* are provided on the end portions of the earth contact plate springs 123 and 123', respectively. The make contact 121*a* is provided at a position between the make contact 121*a'* and the earth contact 123*a'*. The break contact 122*a* is provided at a position between the break contact 122*a'* and the earth contact 123*a*.

FIG. 3 is a plan view showing the relay board 110 of the conventional electromagnetic relay 101.

Make contact terminals 111' and 111 are provided at such positions as to match with the make contacts 121*a* and 121*a'*, on the relay board 110 of the electromagnetic relay 101, respectively. Brake contact terminals 112' and 112 are provided at such positions as to match with the break contacts 122*a* and 122*a'* on the relay board 110, respectively. Earth contact terminals 113 and 113' are provided at such positions as to match the earth contacts 123*a* and 123*a'* on the relay board 110 of the electromagnetic relay 101, respectively. A coil contact terminal 114 is provided at a position at which the earth contact terminal 113' is put between the coil contact terminal 114 and the make contact terminal 111'. A coil contact terminal 114' is provided at a position at which the earth contact terminal 113 is put between the coil contact terminal 114' and the break contact terminal 112'. These contact terminals are positioned on the lengthwise end portions of the relay board 110.

The make contact terminals 111 and 111' are provided with make fixed contacts 111*a* and 111*a'* formed on the front surface of the relay board 110 and make solder connection pads 111*b* and 111*b'* formed on the back surface of the board 110, respectively. The make fixed contacts 111*a* and 111*a'* are signal fixed contacts and the make solder connection pads 111*b* and 111*b'* are used to be mounted on an external mounting board (not shown). The break contact terminals 112 and 112' are provided with break fixed contacts 112*a* and 112*a'* formed on the front surface of the relay board 110 and break solder connection pads 112*b* and 112*b'* formed on the back surface thereof, respectively. The break fixed contacts 112*a* and 112*a'* are signal fixed contacts and the make solder connection pads 112*b* and 112*b'* are used to be mounted on the external mounting board.

The earth contact terminals 113 and 113' are provided with earth fixed contacts 113*a* and 113*a'* formed on the front surface of the relay board 110 and earth solder connection pads 113*b* and 113*b'* formed on the back surface thereof, respectively. The coil contact terminals 114 and 114' are provided with coil fixed contacts 114*a* and 114*a'* formed on the front surface of the relay board 110 and coil solder connection pads 114*b* and 114*b'* formed on the back surface thereof, respectively.

The make fixed contact 111*a'* of the make contact terminal 111' and the break fixed contact 112*a'* of the break contact terminal 112' are connected to each other. The fixed contacts and solder pads of the terminals are connected to one another by connection parts provided within the board, respectively, and the fixed contacts of the respective terminals serve as terminals of the signal transmission path. The earth fixed contacts 113*a* and 113*a*' of the earth contact terminals 113 and 113' are connected to an earth layer 115.

The make contacts 121*a* and 121*a*' of the make contact plate spring 121 are arranged to face the make fixed contact 111*a*' and 111*a*, respectively. The break contacts 122*a* and 122*a*' of the break contact plate spring 122 are arranged to face the break fixed contacts 112*a*' and 112*a*, respectively. The earth contacts 123*a* and 123*a*' of the earth contact plate springs 123 and 123' are arranged to face the earth fixed contacts 113*a* and 113*a*', respectively.

FIG. 4 is a plan view showing the positional relationship between the contact plate spring 120 and the armature 136 in the conventional electromagnetic relay.

In the conventional electromagnetic relay 101 thus constituted, the end portion of the arm 136*a* of the armature 136 is polarized by the magnetic pole 131*a* while the electromagnet 138 is de-excited. At this moment, the free end of the break contact plate spring 122 and that of the earth contact plate spring 123 fixed to the spring fixing part 124, are pressed by the stud 137*b* provided at the arm 136*b* of the armature 136.

The end portion of the arm 136*b* of the armature 136 is polarized by the magnetic pole 131*b* while the electromagnet 138 is excited. At this moment, the free end of the make contact plate spring 121 and that of the earth contact plate spring 123' fixed to the spring fixing part 124, are pressed by the stud 137*a* provided at the arm 136*a* of the armature 136.

In this way, the closing operations of the contacts 122*a*', 122*a* and 123*a* for the respective fixed contacts 112*a*, 112*a*' and 113*a* and those of the contacts 121*a*', 121*a* and 123*a*' for the respective fixed contacts 111*a*, 111*a*' and 113*a*' are conducted alternately. A desired connection state is then selected in the electromagnetic relay 101.

In the above-stated electromagnetic relay, however, while the break contacts 122*a*, 122*a*' and the earth contact 123*a* are connected to the fixed terminals 112', 112 and 113, respectively, for example, as shown in FIG. 4, the following Formula (1) is satisfied, where the distances between the center line parallel to the lengthwise direction of the armature 136 and the contacts 123*a*, 122*a* and 122*a*' are D21, D22, D22', respectively and contact pressing forces applied to the contacts 123*a*, 122*a* and 122*a*' are F21, F22 and F22', respectively:

$$F22\times D22+F22'\times D22'>F21\times D21 \quad (1).$$

The contact pressing force is the repulsion of each of the pressed contact springs.

Due to this, while the contacts 123*a*, 122*a* and 122*a*' are connected to the fixed terminals 112', 112 and 113, respectively, a torque is generated about the center line parallel to the lengthwise direction of the armature 136 and the armature 136 is twisted. As a result, the seesaw operation of the armature 136 is inhibited to thereby disadvantageously adversely influence the closing/opening operation characteristics of the electromagnetic relay.

In the above-stated conventional electromagnetic relay, while the electromagnet 138 is de-excited, the contacts 122*a* and 122*a*' are closed by the fixed contacts 112*a*' and 112*a* and the break contact spring 122 becomes part of the transmission path. On the other hand, the earth contact 123*a*' of the earth contact spring 123' connected to the break contact spring 122 is not connected to anywhere and opened. Owing to this, if seen from the input terminal of the transmission path between the break contacts 122*a* and 122*a*', impedance of the earth contact spring 123' corresponds to being connected in parallel to the transmission path. As a result, input impedance is lowered and the high frequency characteristics of the transmission path deteriorates.

SUMMARY OF THE INVENTION

It is, therefore, an object of the present invention to provide an electromagnetic relay capable of obtaining stable closing/opening operation characteristics, preferably suppressing the impedance of the transmission path from decreasing and improving the high frequency characteristics of the transmission path.

According to one aspect of the present invention, an electromagnetic relay comprises a board and a plurality of movable spring parts each made of a plate conductive member. The includes a plurality of signal fixed contacts constituting terminals of a signal transmission path and an earth fixed contact connected to a ground. Each movable spring part includes a signal contact spring having a signal contact which connects the signal fixed contacts to each other, an earth contact spring having an earth contact connected to the earth fixed contact, and a spring connection portion which connects the signal contact spring to the earth contact spring. The electromagnetic relay further comprises a spring fixing member which fixes the signal contact spring, the earth contact spring and the spring connection portion to the board, and an armature made of a magnetic member and arranged to be rockable with a position matching with the spring fixing part. The armature includes a first end portion which presses the signal contact spring against the signal fixed contacts and a second end portion which presses the earth contact spring against the earth fixed contact. The armature and each of the movable portions are arranged such that torques acting on the armature cancel one another by a repulsion of each of the contact springs when the signal contact spring and the earth contact spring are pressed against the board. The electromagnetic relay further comprises a magnetic force generating part having a first magnetic pole and a second magnetic pole magnetizing the first and second end portions of the armature, respectively. The earth contact spring and the earth fixed contact are closed when the first end portion is magnetized by the first magnetic pole, and the signal contact spring and the signal fixed contacts are closed when the second end portion is magnetized by the second magnetic pole.

According to the present invention, the armature is prevented from being twisted when the contacts of the contact springs are closed by the fixed contacts of the board. Thus, the closing/opening operation characteristics of the electromagnetic relay are improved without hampering the seesaw operation of the armature.

An earth layer may be formed at a front surface of the board, each of the movable spring parts may be arranged above the earth layer; and a width of the spring connection portion may be smaller than widths of the signal contact spring and the earth contact spring. With this constitution, the electrostatic capacity generated between the movable spring parts and the earth layer decreases and the spring connection portion functions to enhance the impedances of the movable spring parts. The decrease of input impedance of the transmission path and the deterioration of the high frequency characteristics of the transmission path are, therefore, suppressed.

The spring fixing part may contain an insulator, and the movable spring parts and the spring fixing part may be formed integrally in a state in which end portions of the signal contact spring and of the earth contact spring supported by and fixed to the spring fixing part and the spring connection portion are buried within the spring fixing part.

Moreover, the magnetic force generating part may comprise an electromagnet having a magnetic core portion and a coil wound around the magnetic core portion, the first and second magnetic poles being provided at both ends of the magnetic core portion, respectively, and a permanent magnet arranged at a central portion of the magnetic core portion. With this constitution, one of the end portions of thearmature is magnetized by one of the magnetic poles of the magnetic force generating part by the magnetic force of the permanent magnet while the electromagnet is de-magnetized and the contact springs fixed to and supported by the other side surface of the spring fixing part are pressed against the relay board, whereby the respective contacts and fixed contacts are closed toward one another. While the electromagnet is excited, the other end portion of the armature is magnetized by the other magnetic pole of the magnetic force generating part and the respective contact springs fixed to and supported by one side surface of the spring fixing part are pressed against the relay board, whereby the contacts and the fixed contacts are closed toward one another.

In addition, the electromagnetic relay may further comprise a hinge spring which abuts one end portion of the armature against one magnetic pole of the magnetic force generating part while the electromagnet is de-excited. With this constitution, when the electromagnet turns into a de-excitation state, one end portion of the armature is instantly abutted against one magnetic pole of the magnetic generating part, thereby making it possible to promptly turn the electromagnetic relay into an initial state.

BRIEF DESCRIPTION OF THE PREFERRED EMBODIMENTS

Figure 1:
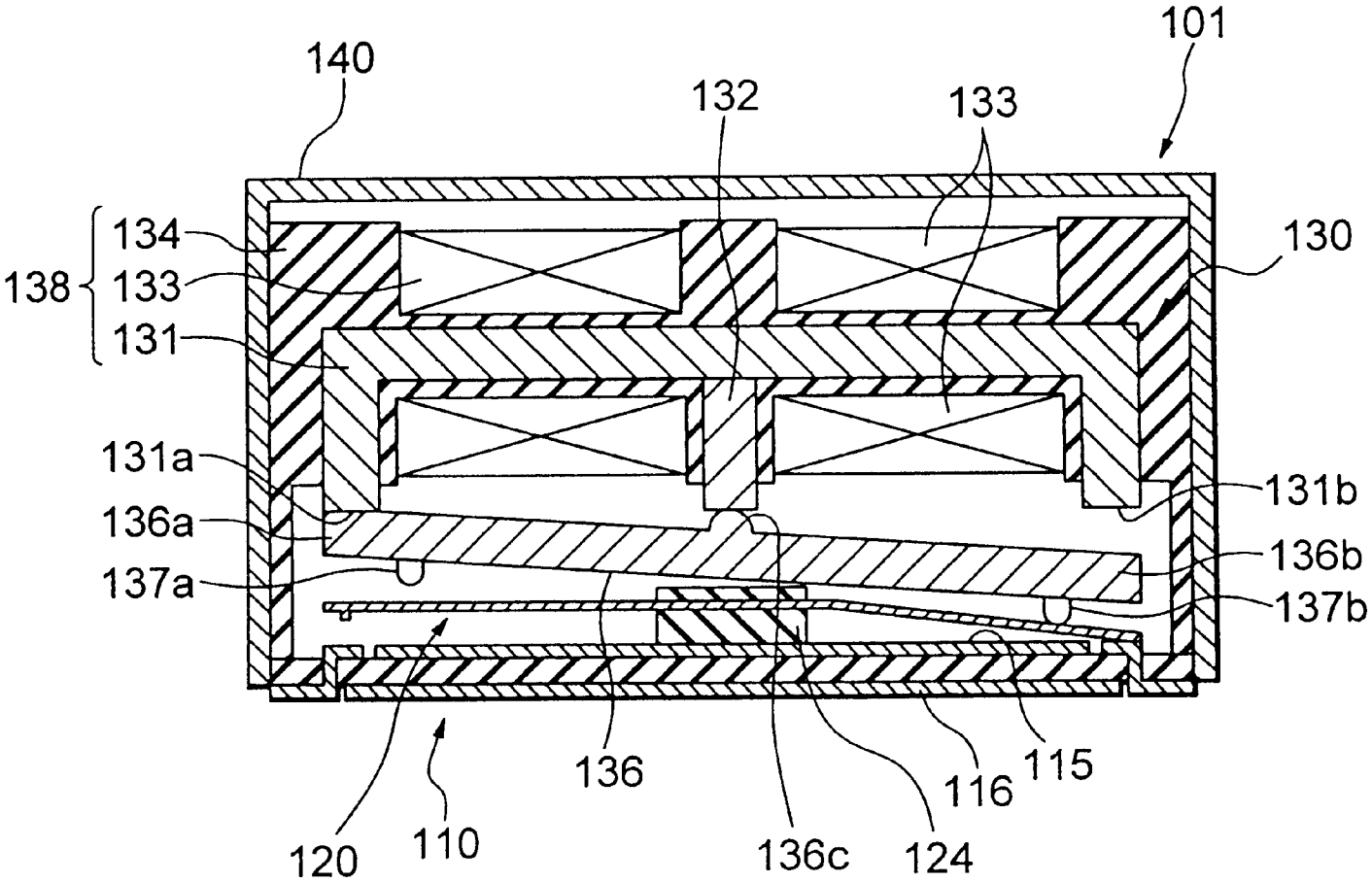
FIG. 1 (PRIOR ART)
FIG. 1 is a cross-sectional view showing a conventional electromagnetic relay.
Figure 2:
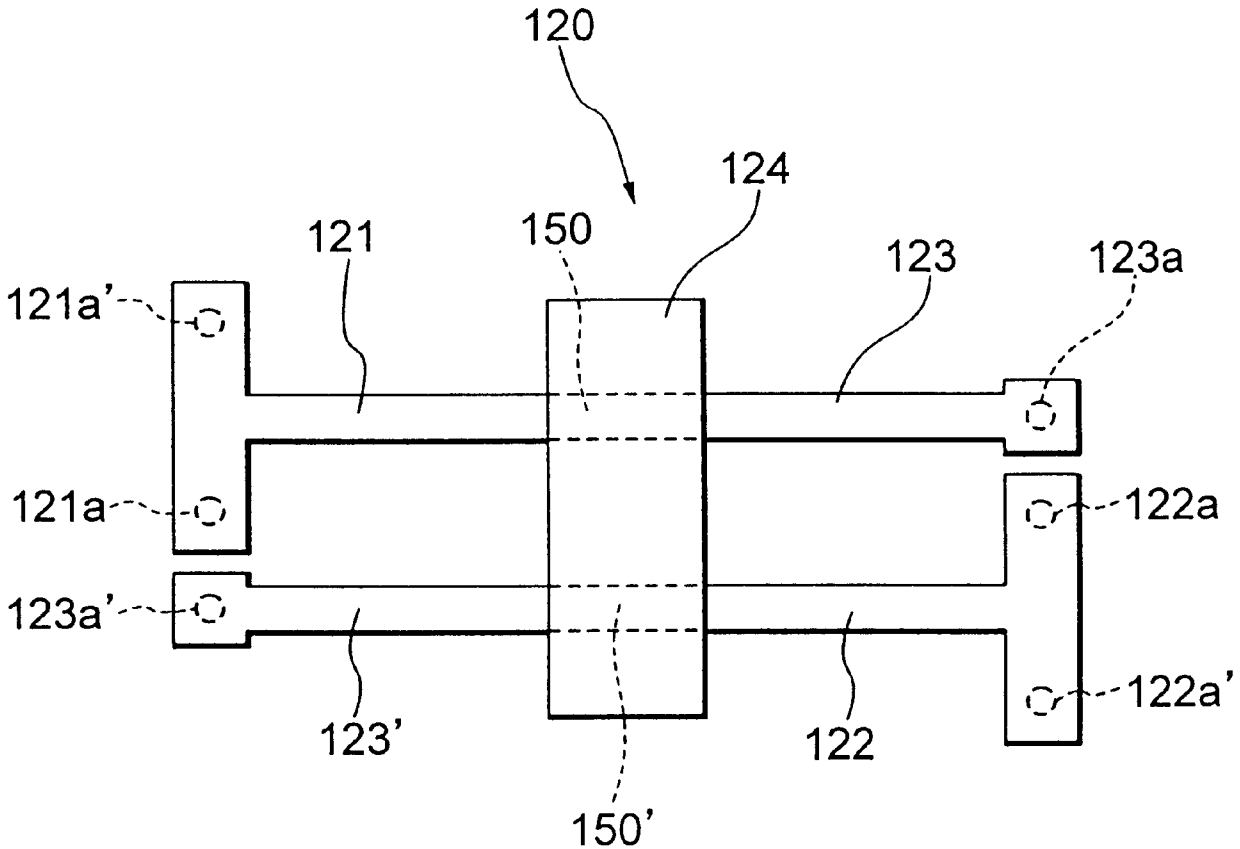
FIG. 2 (PRIOR ART)
FIG. 2 is a plan view showing the contact spring block 120 of the conventional electromagnetic relay 101.
Figure 3:
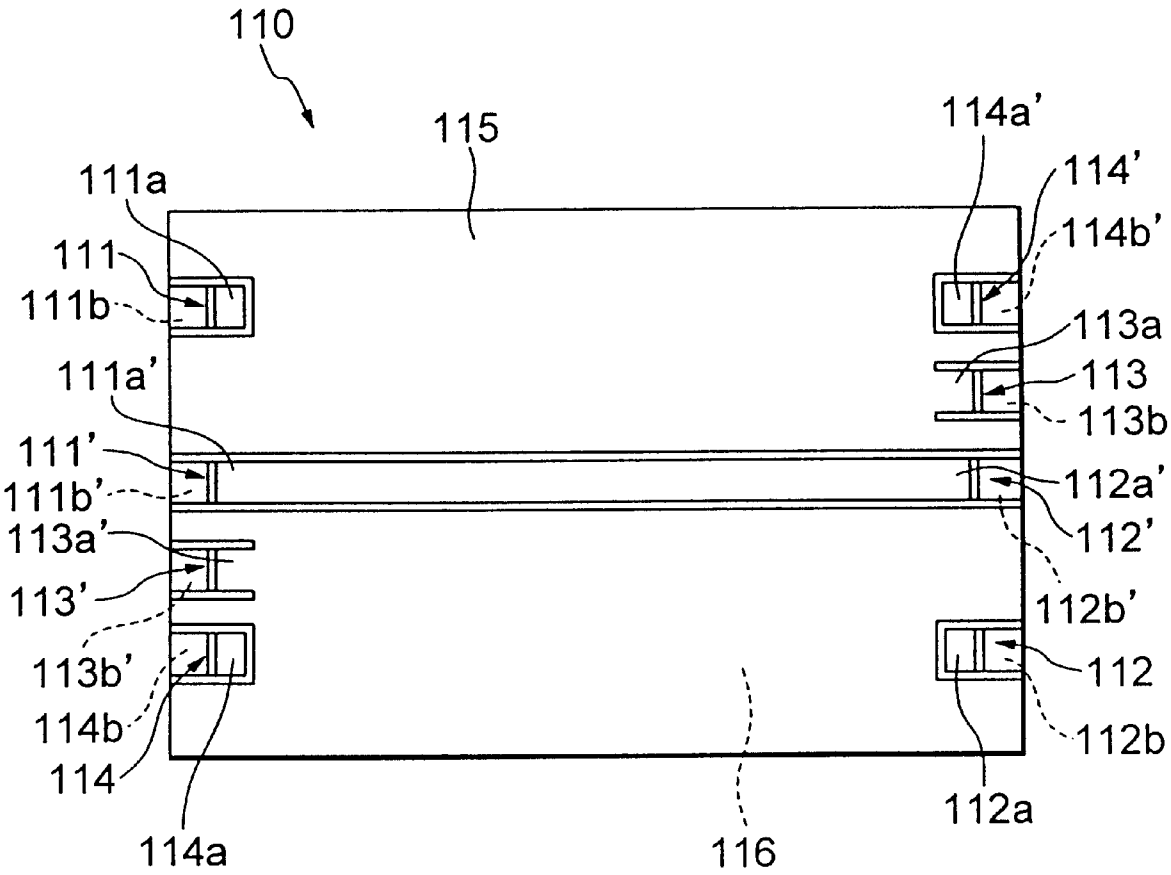
FIG. 3 (PRIOR ART)
FIG. 3 is a plan view showing the relay board 110 of the conventional electromagnetic relay 101.
Figure 4:
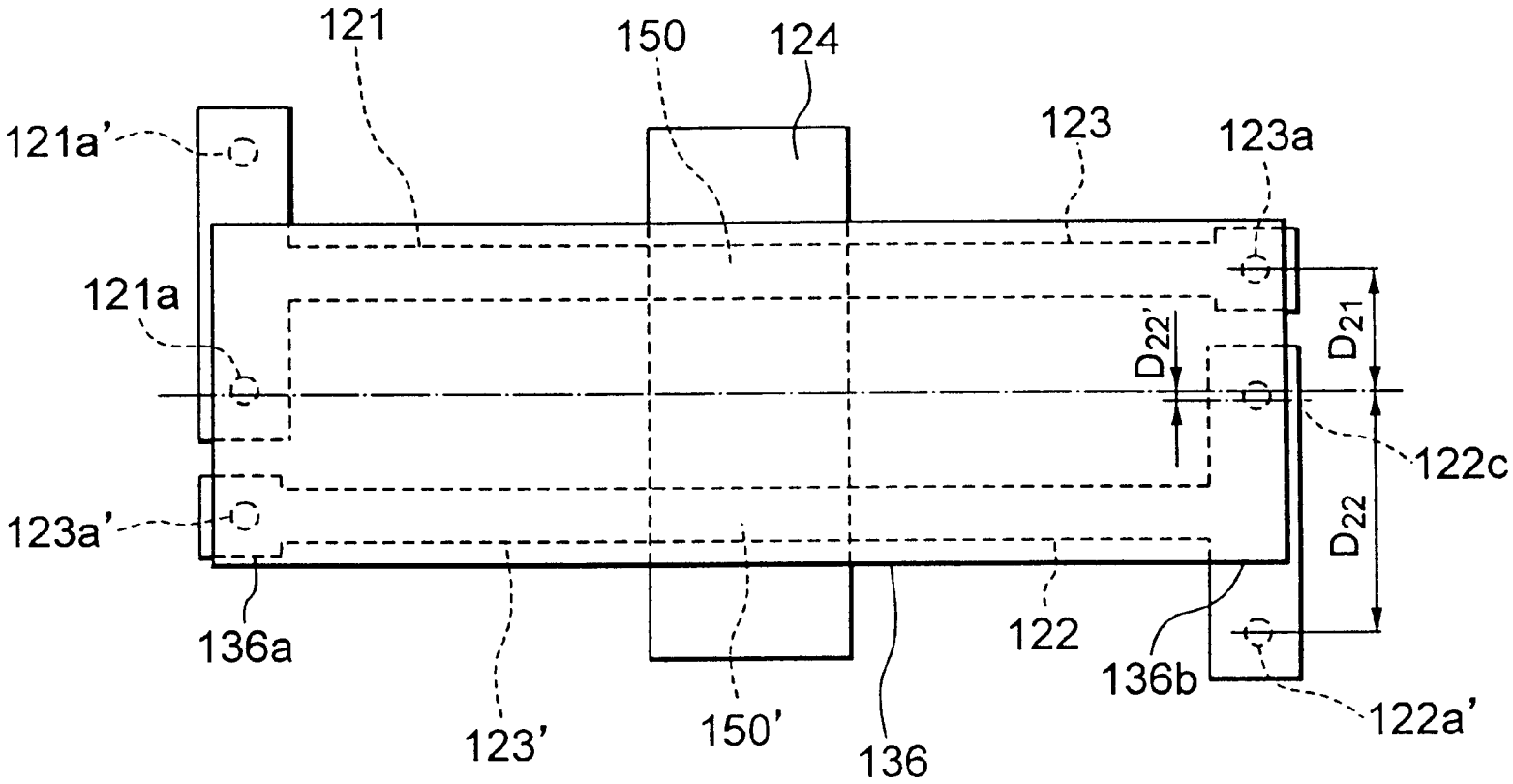
FIG. 4 (PRIOR ART)
FIG. 4 is a plan view showing the positional relationship between the contact spring block 120 and an armature 136.
Figure 5:
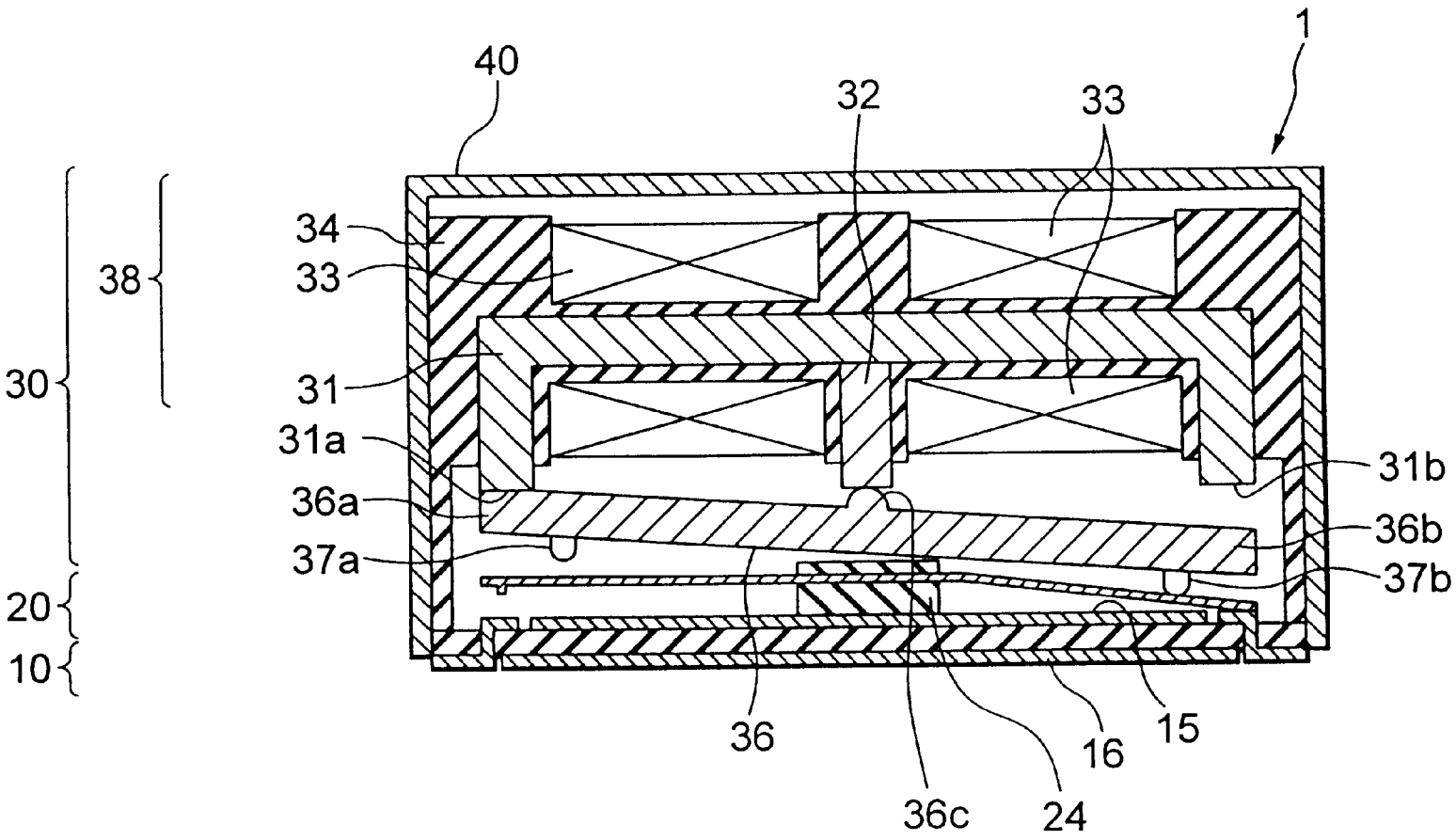
FIG. 5 is a cross-sectional view showing an electromagnetic relay in a first embodiment according to the present invention.

Now, the electromagnetic relays in the embodiments according to the present invention will be specifically described with reference to the accompanying drawings. FIG. 5 is a cross-sectional view showing an electromagnetic relay in a first embodiment according to the present invention.

In an electromagnetic relay 1 in this embodiment, an electromagnet block 30 and a contact spring block 20 are contained within a case 40. An opening portion is provided at the lower portion of the case 40 and a relay board 10 is fitted into the opening portion. The junction between the relay board 10 and the case 40 is bonded with an adhesive agent and the interior of the case 40 is airtight sealed.

A spool 34 formed integrally with a core 31 and an insulating member is provided in the electromagnet block 30. A coil 33 is wound in the groove of the spool 34. The electromagnet 38 thus constituted is provided in the electromagnet block 30. The core 31 is generally U-shaped and the end portions of the core 31 serve as magnetic poles 31*a* and 31*b* of the electromagnet 38, respectively. A permanent magnet 32 is arranged in at the generally central portion of the core 31.

The electromagnetic relay 1 is also provided with an armature 36 made of, for example, magnetic material. A protrusion-like support portion 36*c* polarized by the permanent magnet 32 is formed at the central portion of the armature 36. The armature 36 is rockable like a seesaw with respect to the electromagnet 38 about the support portion 36*c*. Studs 37*a* and 37*b* protruding in opposite direction to the support portions 36*c* are provided on the tip ends of arms 36*a* and 36*b* of the support portion 36, respectively. A hinge spring (not shown) for applying an elastic force in the direction, in which the end portion of the arm 36*a* is abutted against the magnetic pole 31*a*, is provided at the central portion of the armature 36.

The magnetic force of the electromagnet 38 is set higher than a combination of the recovery force of the hinge spring, the magnetic force of the permanent magnet and the like. Thus, while the electromagnet 38 is de-excited, the end portion of the arm 36*a* of the armature 36 is abutted against the magnetic pole 31*a* by the recovery force of the hinge spring and the magnetic force of the permanent magnet 32. While the electromagnet is excited, the end portion of the arm 36*b* is abutted against the magnetic pole 31*b* by the magnetic force of the electromagnet 38.

Figure 6:
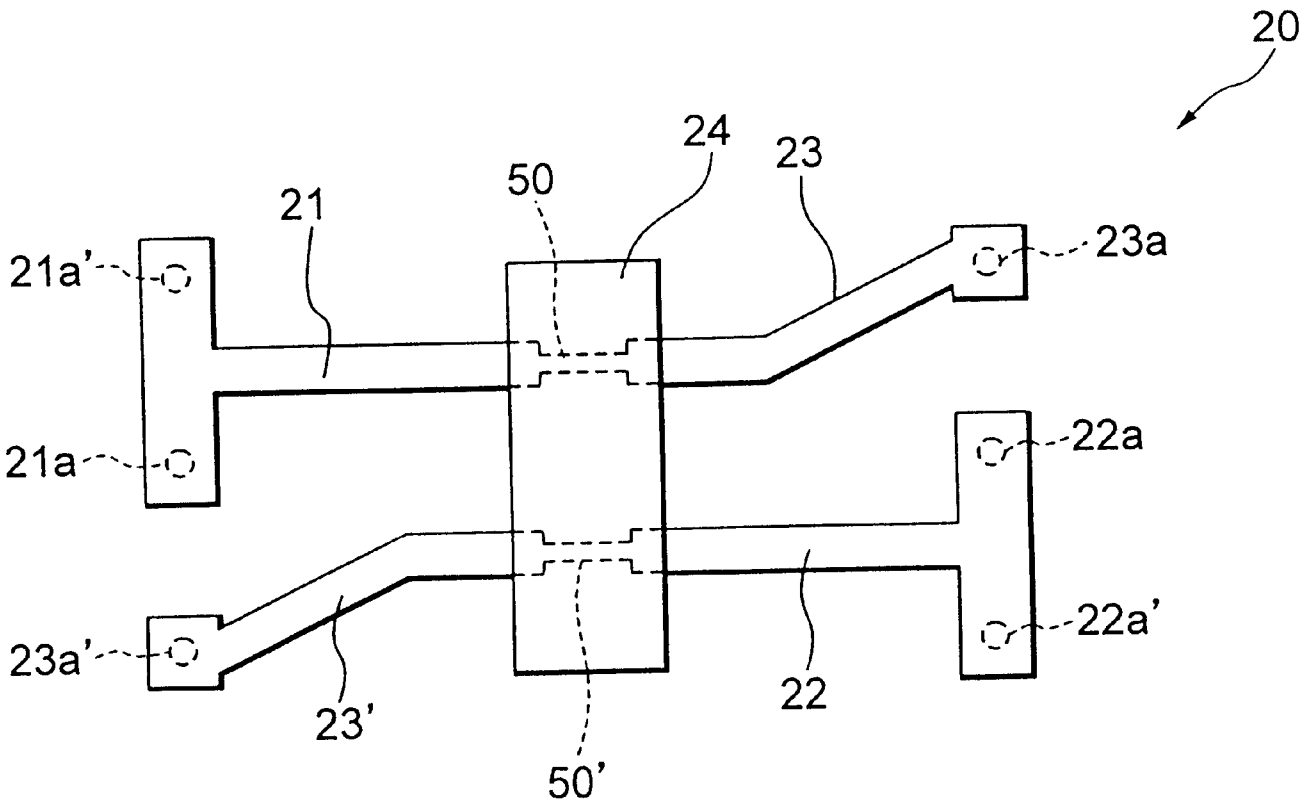
FIG. 6 is a plan view showing the contact spring block 20 of the electromagnetic relay 1 in the first embodiment according to the present invention.

FIG. 6 is a plan view showing a contact spring block 20 of the electromagnetic relay 1 in the first embodiment according to the present invention.

In the contact spring block 20 of the electromagnetic relay 1, a make contact plate spring 21 and an earth contact plate spring 23 serving as signal contact springs are connected to each other by a spring connection portion 50. A break contact plate spring 22 and an earth contact plate spring 23' serving as signal contact springs are connected to each other by a spring connection portion 50'. The widths of the spring connection portions 50 and 50' are smaller than those of the respective contact plate springs. These plate springs are preferably made of conductive members. The first movable spring part is constituted by the make contact plate spring 21, the earth contact plate spring 23 and the spring connection portion 50. The second movable spring part is constituted by the break contact plate spring 22, the earth contact plate spring 23' and the spring connection portion 50'. In the contact spring block 20, the fixed terminals of the respective contact plate springs and the spring connection portions 50 and 50' are buried within a spring fixing part 24. The movable spring parts and the spring fixing part 24 are, therefore, formed integrally. The make contact plate spring 21 and the break contact plate spring 22 are arranged to put the spring fixing part 24 between them.

The earth contact plate spring 23 is bent and the distance to the break contact plate spring 22 is wider as a portion is further away from the spring connection portion 50 between the bending portion and the free end of the plate spring 23. Likewise, the earth contact plate spring 23' is bent and the distance to the break contact plate spring 21 is wider as a portion is further away from the spring connection portion 50' between the bending portion and the free end of the plate spring 23'.

The free end of the make contact plate spring 21 and that of the break contact plate spring 22 are T-shaped. Make contacts 21*a* and 21*a'* are provided on the free end portions of the make contact plate spring 21, respectively. Break contacts 22*a* and 22*a'* are provided on the free end portions of the break contact plate spring 22, respectively. Earth contacts 23*a* and 23*a'* are provided on the end portions of the earth contact plate springs 23 and 23', respectively. The make contact 21*a* is provided at a position between the make contact 21*a'* and the earth contact 23*a'*. The break contact 22*a* is provided at a position between the break contact 22*a'* and the earth contact 23*a*.

Figure 7:
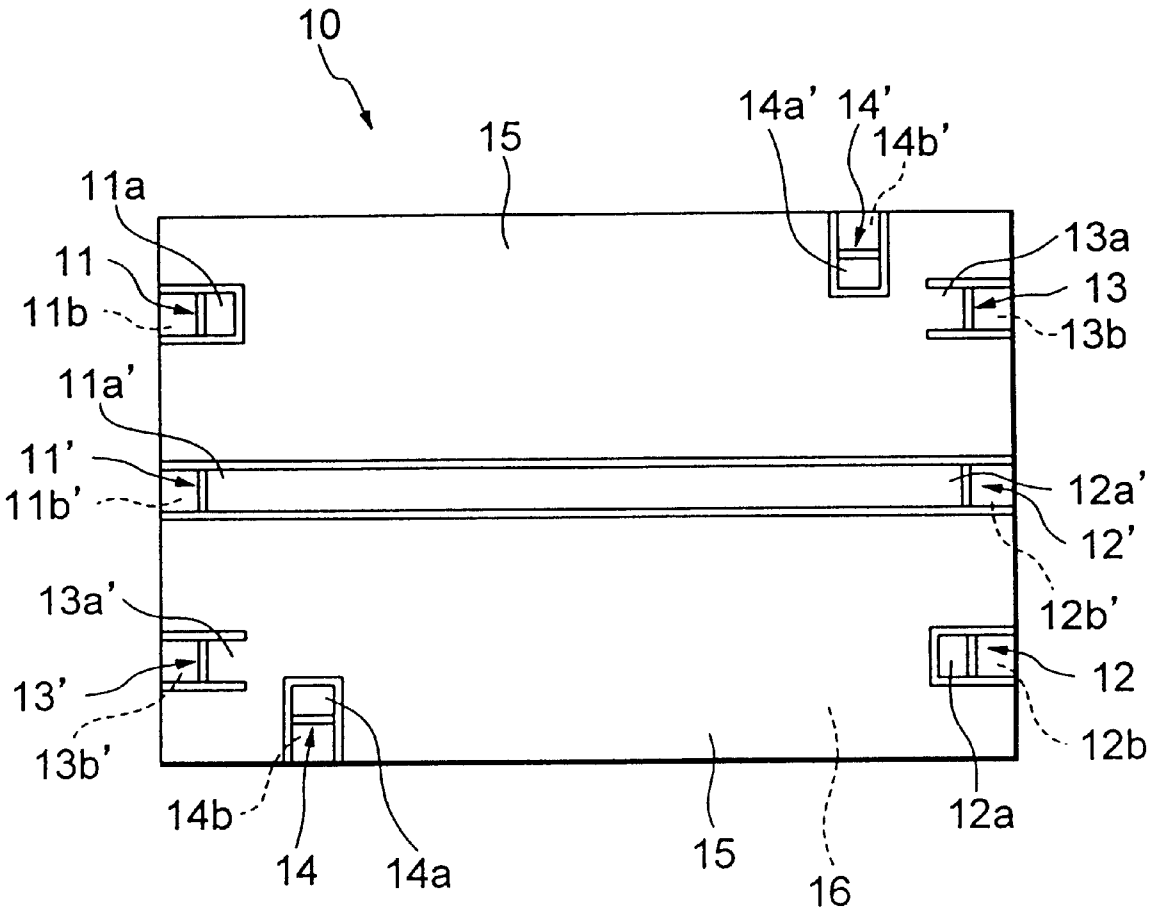
FIG. 7 is a plan view showing the relay board 10 of the electromagnetic relay 1 in the first embodiment according to the present invention.

FIG. 7 is a plan view showing the relay board 10 of the electromagnetic relay 1 in the first embodiment according to the present invention.

Make contact terminals 11' and 11 are provided at such positions as to match with the make contacts 21*a* and 21*a'* on the relay board 10 of the electromagnetic relay 1, respectively. Break contact terminals 12' and 12 are provided at such positions as to match with the break contacts 22*a* and 22*a'* on the relay board 10 of the electromagnetic relay 1, respectively. Earth contact terminals 13 and 13' are provided at such positions as to match with the earth contacts 23*a* and 23*a'* on the relay board 10 of the electromagnetic relay 1, respectively.

These contact terminals are positioned at lengthwise end portions of the relay board 10.

Coil terminals 14 and 14' are provided at widthwise end portions of the relay board 10 of the electromagnetic relay 1. The coil terminal 14 is provided in the vicinity of the earth contact terminal 13' and the coil terminal 14' is provided in the vicinity of the earth contact terminal 13.

The make contact terminals 11 and 11' are provided with make fixed contacts 11*a* and 11*a'* formed on the front surface of the relay board 10 and make solder connection pads 11*b* and 11*b'* formed on the back surface thereof, respectively. The make fixed contacts 11*a* and 11*a'* are signal fixed contacts and the make solder connection pads 11*b* and 11*b'* are used to be mounted on an external mounting board (not shown). The break contact terminals 12 and 12' are provided with break fixed contacts 12*a* and 12*a'* formed on the front surface of the relay board 10 and break solder connection pads 12*b* and 12*b'* formed on the back surface thereof, respectively. The break fixed contacts 12*a* and 12*a'* are signal fixed contacts and the make solder connection pads 12*b* and 12*b'* are used to be mounted on the external mounting board.

The earth contact terminals 13 and 13' are provided with earth fixed contacts 13*a* and 13*a'* formed on the front surface of the relay board 10 and earth solder connection pads 13*b* and 13*b'* formed on the back surface thereof, respectively.

The coil contact terminals 14 and 14' are provided with coil fixed contacts 14*a* and 14*a'* formed on the front surface of the relay board 10 and coil solder connection pads 14*b* and 14*b'* formed on the back surface thereof, respectively.

The make fixed contact 11*a'* of the make contact terminal 11' is connected to the break fixed contact 12*a'* of the break contact terminal 12'. The fixed contacts and solder pads of the respective terminals are connected to one another by connection portions provided within the board. The fixed contacts of the respective terminals serve as terminals of a signal transmission path. The earth fixed contacts 13*a* and 13*a'* of the respective earth contact terminals 13 and 13' are connected to an earth layer 15.

The make contacts 21*a* and 21*a'* of the make contact plate spring 21 are arranged to face the make fixed contacts 11' and 11, respectively. The break contacts 22*a* and 22*a'* of the break contact plate spring 22 are arranged to face the break fixed contacts 12*a'* and 12*a*, respectively. The earth contacts 23*a* and 23*a'* of the earth contact plate springs 23 and 23' are arranged to face the earth fixed contacts 13*a* and 13*a'*, respectively.

The respective contact terminals and coil terminals are formed by bending lead frame pieces formed by punching part of a lead frame, respectively. These processing allow the fixed contacts to be arranged on the front surface of the relay board 10, the solder pads to be arranged on the back surface thereof and the fixed contacts and the solder pads to be connected to one another by the connection portions provided within the board 10. Each of the solder pads is used to be mounted on the external mounting board (not shown). The front surface of each fixed contact is, for example, plated or welded with noble metal.

The earth layer 15 on the front surface side of the relay board 10 is formed by punching the portions, at which the fixed contacts of the respective terminals are provided, from a lead frame by means of pressing. Likewise, the earth layer 16 on the back surface side of the relay board 10 is formed by punching the portions, at which the solder pads of the respective terminals are provided, from a lead frame by means of pressing.

The relay board 10 in this embodiment is constituted such that the respective terminals constituted as stated above and the earth layers are insert-molded with insulating members.

The bending degrees of the earth contact plate springs 23 and 23' are to the effect that torques acting around a center line parallel to the lengthwise direction of the armature 36 cancel one another by the repulsions of the respective contact springs.

Next, the operation of the electromagnetic relay 1 constituted as stated above will be described.

Figure 8:
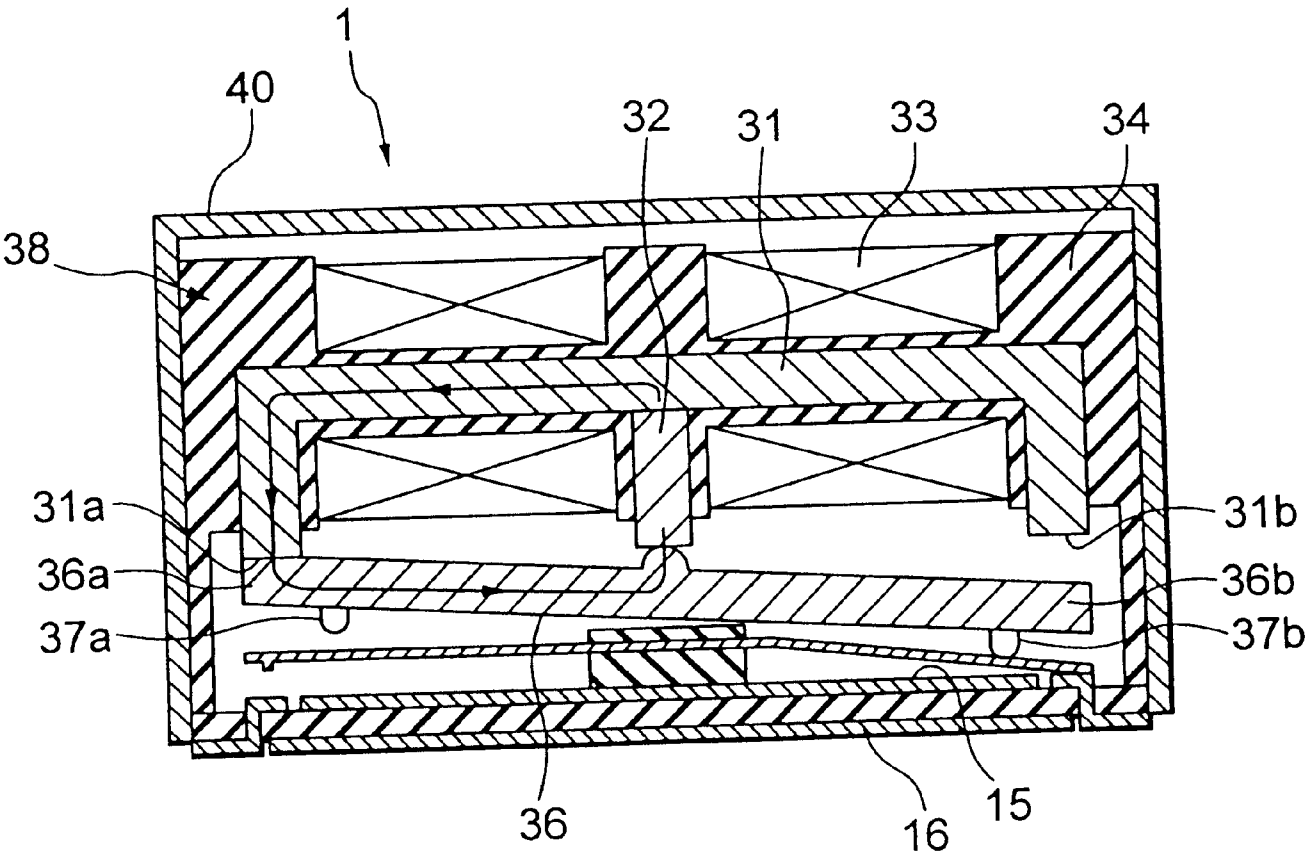
FIG. 8 is a cross-sectional view showing the de-excitation state of the electromagnetic relay in the first embodiment according to the present invention.
Figure 9:
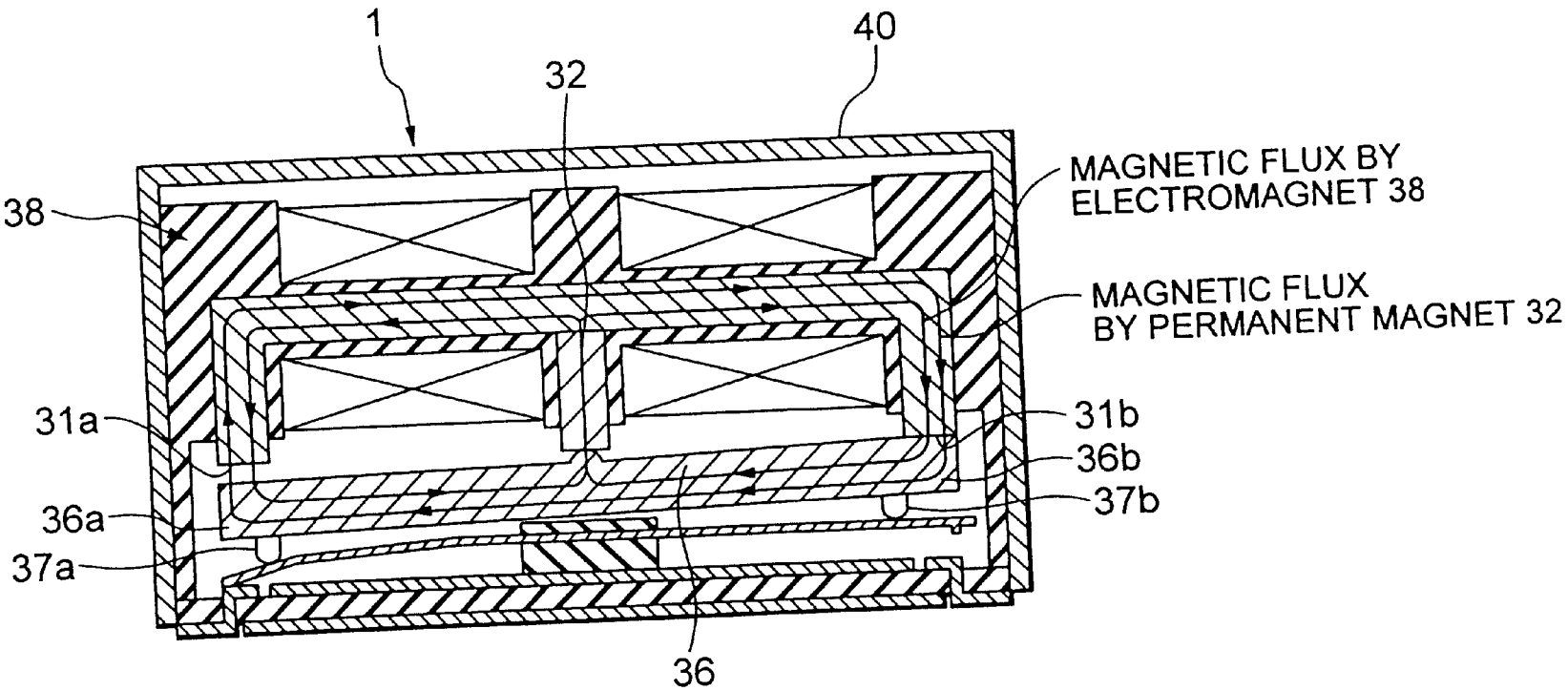
FIG. 9 is a cross-sectional view showing the excitation state of the electromagnetic relay in the first embodiment according to the present invention.

FIG. 8 is a cross-sectional view showing the de-excitation state of the electromagnetic relay in the first embodiment according to the present invention. FIG. 9 is a cross-sectional view showing the excitation state of the electromagnetic relay in the first embodiment according to the present invention.

While the electromagnet 38 is de-excited, one arm 36*a* of the armature 36 is abutted against the magnetic pole 31*a* by the magnetic force of the permanent magnet 32 and the recovery force of the hinge spring, as shown in FIG. 8. At this moment, the break contact plate spring 22 and the earth contact plate spring 23 are pushed downward by the stud 37*b* provided on the other arm 36*b* of the armature 36. Due to this, the break contacts 22*a* and 22*a'* of the break contact spring 22 and the earth contact 23*a* of the earth contact spring 23 are closed to the fixed contacts 12*a*, 12*a'* and 13*a* on the relay board 10, respectively.

Meanwhile, the make contacts 21*a* and 21*a*' of the make contact plate spring 21 are opened. However, the earth contact 23*a* of the earth contact plate spring 23 connected to the make contact plate spring 21 is closed to the earth fixed contact 13*a*, the make contact spring 21 is grounded. Also, since the opened make fixed contacts 11*a* and 11*a*' are not closed to the grounded make contact plate spring 21 adjacent to the upper portions thereof and the earth layers 15 and 16 provided on the front and back surfaces of the relay board 10, the leakage of signals between the make fixed contacts 11*a* and 11*a*' is prevented.

When the electromagnet 38 is excited, the magnetic flux of the electromagnet 38 occurs in the direction in which the magnetic flux of the permanent magnet 32 passing the arm 36*a* of the armature 36 polarized by the magnetic pole 31*a* is cancelled by the magnetic flux of the electromagnet 38, as shown in FIG. 9. Therefore, the magnetic force between the arm 36*a* of the armature 36 and the magnetic pole 31*a* is eliminated.

In the meantime, the magnetic flux of the electromagnet 38 and that of the permanent magnet 32 are added together and the magnetic force thereby increases at the other arm 36*b* of the armature. As a result, so that the armature 36 is reversed and the arm 36*b* is polarized by the magnetic pole 31*b*. At this moment, the break contacts 22*a* and 22*a*' of the break contact plate spring 22 and the earth contact 23*a* of the earth contact plate spring 23 are opened. The make contact plate spring 21 and the earth contact plate spring 23' are pushed downward by the stud 37*a* provided on the arm 36*a* of the armature 36. Therefore, the break contacts 22*a* and 22*a*' and the earth contact 23' are closed to the fixed contacts 11*a*, 11*a*' and 13*a*' of the relay board 10, respectively.

Thereafter, when the electromagnet is de-excited again, the magnetic flux of the electromagnet 38 passing the armature 36 is eliminated. As a result, the electromagnetic relay 1 returns to the initial state as shown in FIG. 8 by the recovery force of the hinge spring (not shown) and the like.

As can be seen from the above, since the hinge spring is provided in this embodiment, the arm 36*a* of the armature 36 is instantly abutted against the magnetic pole 31*a* when the electromagnet 38 turns into a de-excitation state. Thus, it is possible to instantly turn the electromagnetic relay 1 into the initial state.

Figure 10:
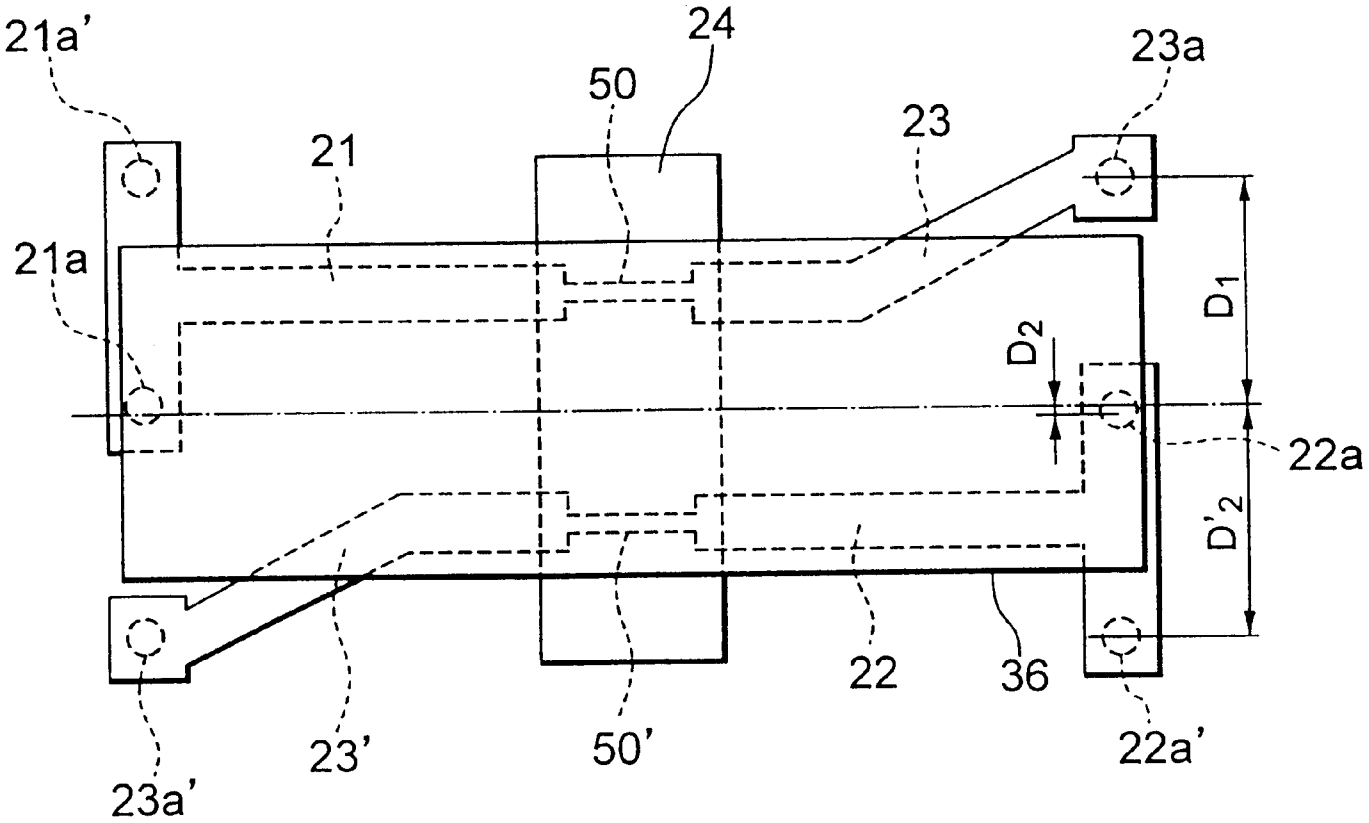
FIG. 10 is a plan view showing the positional relationship between the contact spring block 20 and an armature 36 in the first embodiment according to the present invention.

FIG. 10 is a plan view showing the positional relationship between the contact spring block 20 and the armature 36 in the first embodiment according to the present invention.

While the break contacts 22*a*, 22*a*' and the earth contact 23*a* are connected to, for example, the fixed terminals 12', 12 and 13, respectively, the following Formula (2) is satisfied from the balance of moments, where the distances between the center line parallel to the lengthwise direction of the armature 36 and the contacts 23*a*, 22*a* and 22*a*' are D1, D2 and D2', respectively, contact pressing forces applied to the contacts 23*a*, 22*a* and 22*a*' are F1, F2 and F2', respectively:

$$F2\times D2+F2'\times D2'=F1\times D1 \quad (2)$$

As stated above, in this embodiment, the earth contact plate spring 23 is bent and the contacts 22*a*, 22*a*' and 23*a* are arranged such that torques acting around the center line parallel to the lengthwise direction of the armature 36 cancel one another by the repulsions of the respective pressed contact springs. Therefore, as shown in the Formula (2), the armature 36 is prevented from being twisted when the contacts 23*a*, 22*a* and 22*a*' are closed to the fixed terminals 12', 12 and 13, respectively. As a result, it is possible to improve the closing/opening characteristics of the electromagnetic relay 1 without hampering the seesaw operation of the armature 36.

It is noted that the earth contact plate spring 23' is bent. Even if the make contacts 21*a* and 21*a*' of the make contact plate spring 21 and the earth contact 23*a*' are closed to the fixed terminals 11', 11 and 13', respectively, the contacts 21*a*, 21*a*' and 23*a*' are arranged such that torques acting around the center line parallel to the lengthwise direction of the armature 36 cancel one another. Thus, even if the contacts 21*a*, 21*a*' and 23*a*' are closed to the fixed terminals 11', 11 and 13', respectively, the armature 36 is not twisted.

As stated above, while the electromagnet 38 is, for example, de-excited, the break contact plate spring 22 causes a short-circuit between the break fixed contacts 12*a* and 12*a*' and functions as part of a transmission path. At this moment, the earth contact plate spring 23' connected to the break contact plate spring 22 is in an open state in which the spring 23' is not connected to anywhere. Owing to this, if seen from the input terminal of the transmission path, the impedances of the break contact plate spring 22 and the earth contact plate spring 23' are connected in parallel to the transmission path to thereby decrease the input impedance of the transmission path.

The overall impedance Zin [Ω] of the break contact plate spring 22 and the earth contact plate spring 23' is determined by the earth layer 15 provided on the front surface of the relay board 10 and the contact plate springs 22 and 23' and the spring connection portion 50' arranged above the earth layer 15, and is expressed by the following Formula (3):

$$Zin = 1/j\omega C(\text{when } L<\lambda g/4) \quad (3)$$

In the Formula (3), L is the length [mm] between the transmission path of the contact plate spring and the tip end of the earth contact, C is an electrostatic capacity [F] which occurs between the contact plate springs 22, 23' and the earth layer 15 of the relay board 10, ω is an angular speed [rad/s] and λg is a wavelength [mm].

In the electromagnetic relay 1 in this embodiment, however, the width of the connection part 50' is smaller than those of the contact plate springs 22 and 23' and the width of the connection part 50 is smaller than those of the contact plate springs 21 and 23. For those reasons, the electrostatic capacity which occurs between the movable spring part and the earth layer 15 decreases. Therefore, the connection parts 50 and 50' serve to increase the impedance of the movable spring part, thereby suppressing the decrease of the input impedance of the transmission path. As a result, it is possible to prevent the deterioration of the high frequency characteristics of the transmission path.

Figure 11:
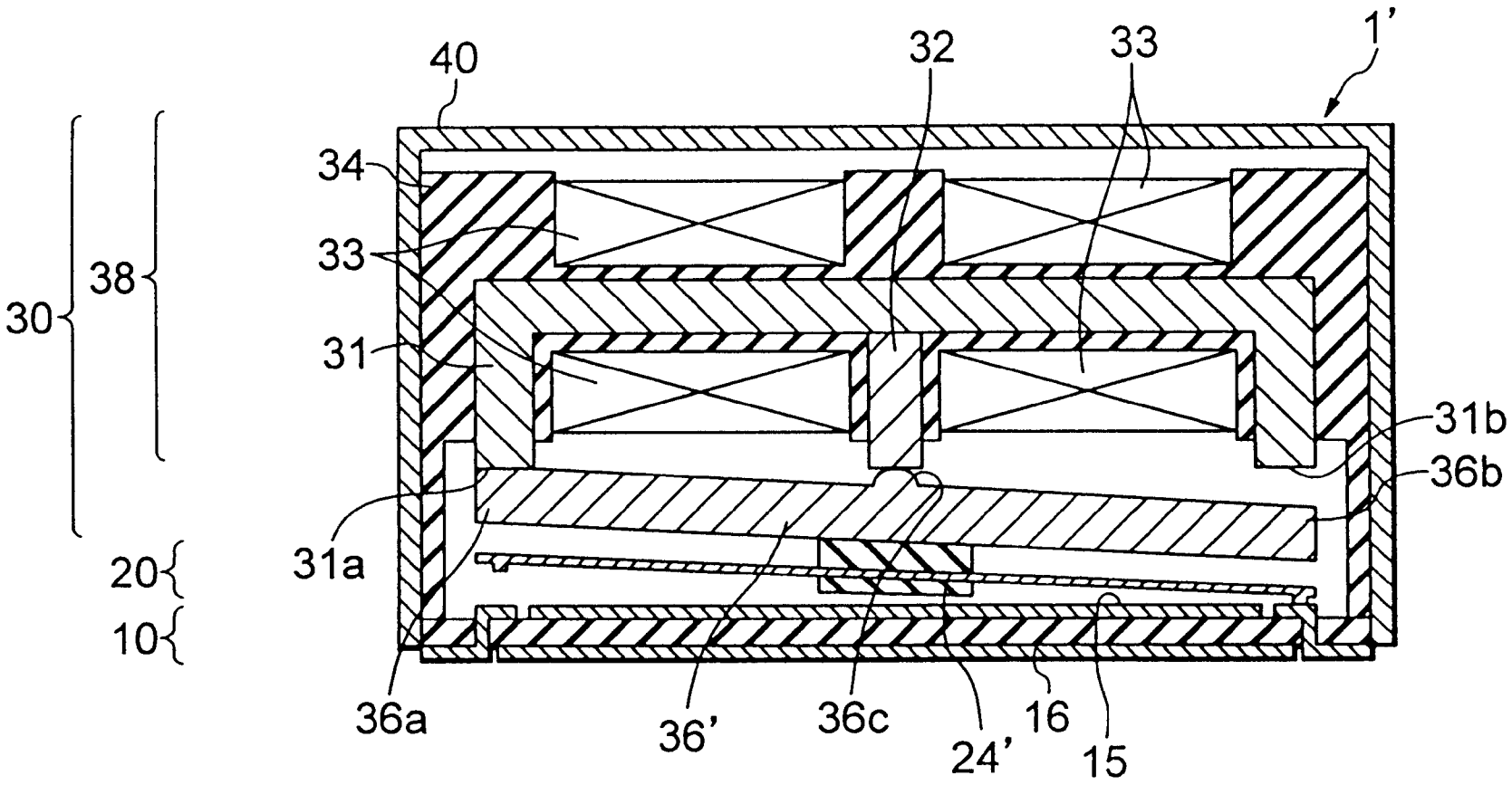
FIG. 11 is a cross-sectional view showing an electromagnetic relay in a second embodiment according to the present invention.

Next, the second embodiment according to the present invention will be described. In the second embodiment, a spring fixing part is fixed not to a relay board but to an armature. FIG. 11 is a cross-sectional view showing an electromagnetic relay in the second embodiment according to the present invention. It is noted that the same constituent elements in the second embodiment shown in FIG. 11 as those in the first embodiment shown in FIG. 5 and the like are denoted by the same reference symbols and the detailed description thereof will not be given herein.

In an electromagnetic relay 1' in the second embodiment, a spring fixing part 24' is fixed to such a position as to match with the support portion 36*c* on the back surface of an armature 36'. Thus, in the second embodiment, a movable spring part fixed to the spring fixing part 24' is rocked together with the armature 36' and the contacts of the respective contact plate springs are pressed against fixed terminals provided on the relay board 10. The studs provided in the first embodiment are not provided on the armature 36'.

Figure 12:
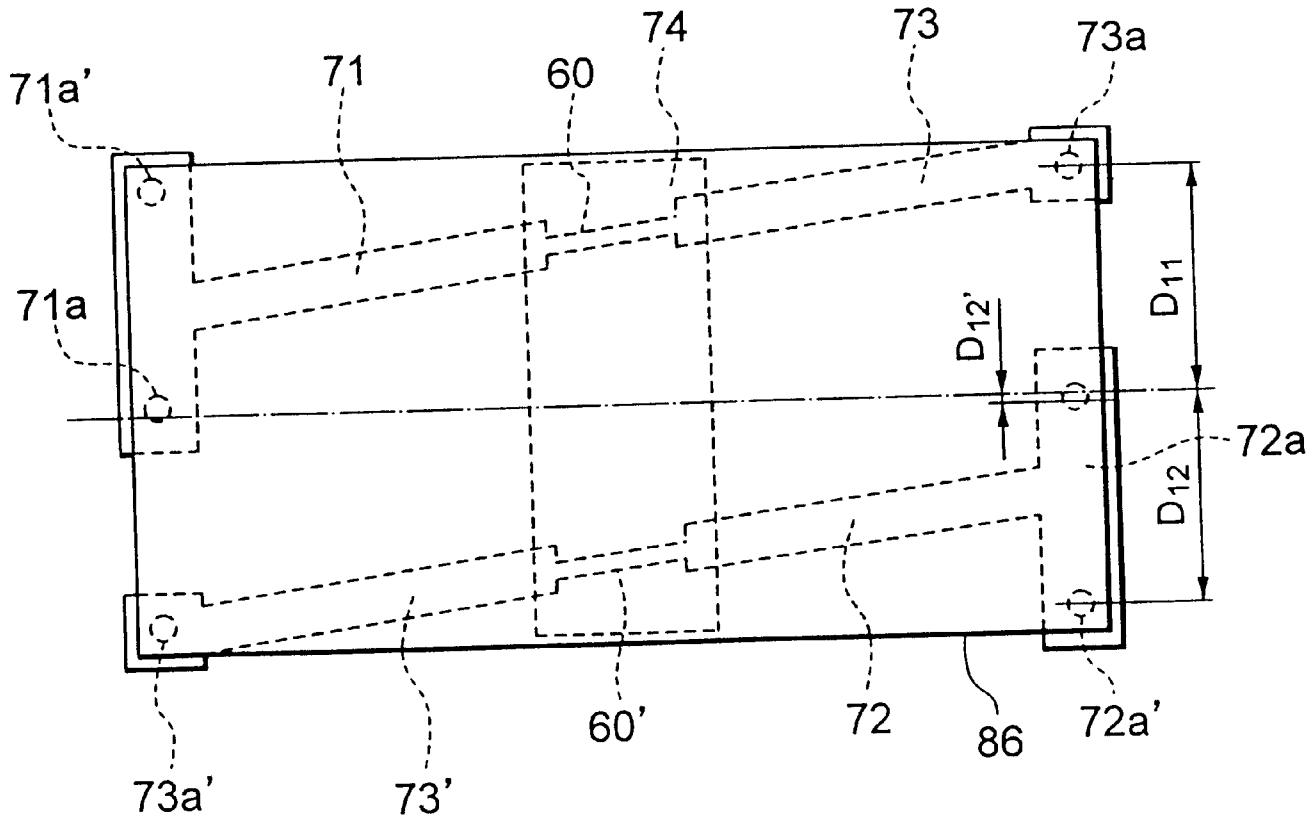
FIG. 12 is a plan view showing the positional relationship between a contact spring block 20' and an armature 86 in the second embodiment according to the present invention.

FIG. 12 is a plan view showing the positional relationship between a contact spring block 20' and the armature 36' in the second embodiment according to the present invention.

In a contact spring block 20' of the electromagnetic relay 1' in the second embodiment, a make contact plate spring 71 and an earth contact plate spring 73 serving as signal contact springs are connected to each other by a spring connection portion 60. A break contact plate spring 72 and an earth contact plate spring 73' serving as signal contact springs connected to each other by a spring connection portion 60'. The widths of the spring connection portions 60 and 60' are smaller than those of the respective contact plate springs. These plate springs are preferably made of conductive members. A first movable spring part is constituted by the make contact plate spring 71, the earth contact plate spring 73 and the spring connection portion 60. A second movable spring part is constituted by the break contact plate spring 72, the earth contact plate spring 73' and the spring connection portion 60'. In the contact spring block 20', the fixed terminals of the respective contact plate springs and the connection portions 60 and 60' are buried within the spring fixing part 24'. The movable spring parts and spring fixing part 24' are, therefore, formed integrally. The make contact plate spring 71 and the break contact plate spring 72 are arranged to put the spring fixing part 24' between them.

In the second embodiment, the first and second movable spring parts are arranged in parallel with each other. It is noted, however, that the first and second movable parts extend in an direction inclined from the lengthwise direction of the armature 36.

As in the case of the first embodiment, make contacts 71*a* and 71*a*', are provided on the free end portions of the make contact plate spring 71, respectively, and break contacts 72*a* and 72*a*' are provided on the free end portions of the break contact plate spring 72, respectively. Earth contacts 73*a* and 73*a*, are provided on the free end portions of the earth contact plate springs 73 and 73', respectively. The make contact 71*a* is provided at a position between the make contact 71*a*' and the break contact 73*a*'. The break contact 72*a* is provided at a position between the break contact 72*a*' and the earth contact 73*a*.

The inclination degrees from the lengthwise direction of the armature 86 in the direction in which the first and second movable spring parts extend, are to the effect that torques acting around the center line parallel to the lengthwise direction of the armature 86 cancel one another by the repulsions of the contact springs.

In the second embodiment constituted as stated above, while the break contacts 72*a*, 72*a*' and the earth contact 73*a* are closed to the fixed terminals 12', 12 and 13, respectively, for example, the following Formula (4) is satisfied, where the distances between a center line parallel to the lengthwise direction of the armature 86 and the contacts 73*a*, 72*a* and 72*a*' are D11, D12 and D12', respectively, and contact pressing forces applied to the contacts 73*a*, 72*a* and 72*a*' are F11, F12 and F12', respectively:

$$F12\times D12+F12'\times D12'=F11\times D11 \quad (4)$$

Thus, while the contacts 72*a*, 72*a*' and 73*a* are closed to be connected to the fixed terminals 12', 12 and 13, respectively, the armature 86 is prevented from being twisted. Likewise, while the contacts 71*a*, 71*a*, 73*a*' are closed to be closed to the fixed terminals 11', 11 and 13', respectively, the armature 86 is not twisted. It is, therefore, possible to improve the closing/opening operation characteristics of the electromagnetic relay without hampering the seesaw operation of the armature 86.

Furthermore, in the second embodiment as in the first embodiment, the widths of the connection portions 60 and 60' are smaller than those of the respective contact plate springs, thereby the electrostatic capacities generated between the movable spring parts and the earth layer 15, respectively, are small. As a result, the connection portions 60 and 60' function to improve the impedances of the first and second movable spring parts, respectively, thereby making it possible to suppress the decrease of the input impedance of the transmission path and to prevent the deterioration of the high frequency characteristics of the transmission path.

As stated above, in the second embodiment as in the case of the first embodiment, the contacts are opened/closed to the terminals according to the excitation/de-excitation of the electromagnet 38. Hence, the electromagnetic relay 1' in the second embodiment can obtain the same function and advantage as those of the electromagnetic relay 1 in the first embodiment.

What is claimed is:

1. An electromagnetic relay comprising:

a board, said board including:

a plurality of signal fixed contacts constituting terminals of a signal transmission path; and an earth fixed contact connected to a ground;

a plurality of movable spring parts each made of a plate conductive member, each movable spring part including:

a signal contact spring having a signal contact which connects said signal fixed contacts to each other;

an earth contact spring having an earth contact connected to said earth fixed contact; and a spring connection portion which connects said signal contact spring to said earth contact spring;

a spring fixing member which fixes said signal contact spring, said earth contact spring and said spring connection portion to said board;

an armature made of a magnetic member and arranged to be rockable with a position matching with said spring fixing part, said armature including a first end portion which presses said signal contact spring against said signal fixed contacts and a second end portion which presses said earth contact spring against said earth fixed contact, and said armature and each of said movable portions being arranged such that torques acting on said armature cancel one another by a repulsion of each of said contact springs when said signal contact spring and said earth contact spring are pressed against said board; and a magnetic force generating part having a first magnetic pole and a second magnetic pole magnetizing said first and second end portions of said armature, respectively, said earth contact spring and said earth fixed contact being closed when said first end portion is magnetized by said first magnetic pole, and said signal contact spring and said signal fixed contacts being closed when said second end portion is magnetized by said second magnetic pole.

2. The electromagnetic relay according to claim 1, wherein an earth layer is formed at a front surface of said board, each of said movable spring parts is arranged above said earth layer, and a width of said spring connection portion is smaller than widths of said signal contact spring and said earth contact spring.

3. The electromagnetic relay according to claim 1, wherein said spring fixing part contains an insulator, and said movable spring parts and said spring fixing part are formed integrally in a state in which end portions of said signal contact spring and of said earth contact spring supported by and fixed to said spring fixing part and said spring connection portion are buried within said spring fixing part.

4. The electromagnetic relay according to claim 1, wherein said magnetic force generating part comprises:

an electromagnet having a magnetic core portion and a coil wound around said magnetic core portion, said first and second magnetic poles being provided at both ends of said magnetic core portion, respectively; and a permanent magnet arranged at a central portion of said magnetic core portion.

5. The electromagnetic relay according to claim 4, which further comprising a hinge spring which abuts one end portion of said armature against one magnetic pole of said magnetic force generating part while said electromagnet is de-excited.

6. An electromagnetic relay comprising:

a board, said board including:

a plurality of signal fixed contacts constituting terminals of a signal transmission path; and an earth fixed contact connected to a ground;

a plurality of movable spring parts each made of a plate conductive member, each movable spring part including:

a signal contact spring having a signal contact which connects said signal fixed contacts to each other;

an earth contact spring having an earth contact connected to said earth fixed contact; and a spring connection portion which connects said signal contact spring to said earth contact spring; an armature made of a magnetic member, said armature including a first end portion which presses said signal contact spring against said signal fixed contacts and a second end portion which presses said earth contact spring against said earth fixed contact, and said armature and each of said movable portions being arranged such that torques acting on said armature cancel one another by a repulsion of each of said contact springs when said signal contact spring and said earth contact spring are pressed against said board;

a spring fixing member which fixes said signal contact spring, said earth contact spring and said spring connection portion to said armature, said armature being arranged to be rockable with a position matching with said spring fixing part; and a magnetic force generating part having a first magnetic pole and a second magnetic pole magnetizing said first and second end portions of said armature, respectively, said earth contact spring and said earth fixed contact being closed when said first end portion is magnetized by said first magnetic pole, and said signal contact spring and said signal fixed contacts being closed when said second end portion is magnetized by said second magnetic pole.

7. The electromagnetic relay according to claim 6, wherein an earth layer is formed at a front surface of said board, each of said movable spring parts is arranged above said earth layer, and a width of said spring connection portion is smaller than widths of said signal contact spring and said earth contact spring.

8. The electromagnetic relay according to claim 6, wherein said spring fixing part contains an insulator, and said movable spring parts and said spring fixing part are formed integrally in a state in which end portions of said signal contact spring and of said earth contact spring supported by and fixed to said spring fixing part and said spring connection portion are buried within said spring fixing part.

9. The electromagnetic relay according to claim 6, wherein said magnetic force generating part comprises:

an electromagnet having a magnetic core portion and a coil wound around said magnetic core portion, said first and second magnetic poles being provided at both ends of said magnetic core portion, respectively; and a permanent magnet arranged at a central portion of said magnetic core portion.

10. The electromagnetic relay according to claim 5, which further comprising a hinge spring which abuts one end portion of said armature against one magnetic pole of said magnetic force generating part while said electromagnet is de-excited.

* * * * *